United States Patent [19]

Sprecker et al.

[11] Patent Number: 4,534,890

[45] Date of Patent: Aug. 13, 1985

[54] USES OF PARA-ACYLOXYCYCLOHEXYL ALKYLCARBOXYLATES IN AUGMENTING OR ENHANCING THE ORGANOLEPTIC PROPERTIES OF CONSUMABLE MATERIALS

[75] Inventors: Mark A. Sprecker, Sea Bright; Wilhelmus J. Wiegers, Red Bank; Robert P. Belko, Woodbridge; Richard M. Boden, Ocean, all of N.J.

[73] Assignee: International Flavors & Fragrances Inc., New York, N.Y.

[21] Appl. No.: 570,202

[22] Filed: Jan. 12, 1984

[51] Int. Cl.[3] ..... C11B 9/00

[52] U.S. Cl. ..... 252/522 R; 252/8.6; 252/8.9; 252/174.11; 252/522 A; 424/69; 424/70

[58] Field of Search ..... 252/8.6, 8.9, 174.11, 252/522 R, 522 A; 424/69, 70

[56] References Cited

PUBLICATIONS

McCabe et al., CA 49:5383b, (1954).
Sasa et al., CA 80:47549c, (1974).

*Primary Examiner*—Thomas A. Waltz
*Attorney, Agent, or Firm*—Arthur L. Liberman

[57] ABSTRACT

Described is the genus of compounds defined according to the structure:

wherein $R_1$ represents hydrogen or $C_2$–$C_4$ acyl and $R_2$ represents $C_1$–$C_3$ alkyl and uses thereof in augmenting or enhancing the aroma or taste of consumable materials including perfume compositions, colognes, perfumed articles (e.g., solid or liquid anionic, cationic, nonionic or zwitterionic detergents, fabric softener compositions, fabric softener articles, hair preparations, cosmetic powders and the like), foodstuffs, chewing gums, toothpastes, medicinal products, chewing tobaccos, smoking tobacco products and smoking tobacco articles. Also described is a process for preparing para-acyloxycyclohexyl alkylcarboxylates according to the reactions:

and

8 Claims, 10 Drawing Figures

GLC PROFILE FOR EXAMPLE I.

GLC PROFILE FOR EXAMPLE II.

IR SPECTRUM FOR FRACTION 28 OF EXAMPLE I.

NMR SPECTRUM FOR FRACTION 28 OF EXAMPLE I.

IR SPECTRUM FOR FRACTION 14 OF EXAMPLE II.

NMR SPECTRUM FOR FRACTION 14 OF EXAMPLE II.

I R SPECTRUM FOR FRACTION 13 OF EXAMPLE III.

USES OF PARA-ACYLOXYCYCLOHEXYL ALKYLCARBOXYLATES IN AUGMENTING OR ENHANCING THE ORGANOLEPTIC PROPERTIES OF CONSUMABLE MATERIALS

BACKGROUND OF THE INVENTION

The present invention relates to uses of para-acyloxycyclohexyl alkylcarboxylates defined according to the generic structure:

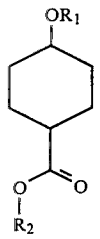

wherein $R_1$ represents hydrogen or $C_2$–$C_4$ acyl and $R_2$ represents $C_1$–$C_3$ alkyl and uses thereof in augmenting or enhancing the aroma or taste of consumable materials including perfume compositions, colognes, perfumed articles, foodstuffs, chewing gums, toothpastes, medicinal products, chewing tobaccos, smoking tobaccos and smoking tobacco articles.

In the perfumery art there is a considerable need for substituents having sweet raspberry, strawberry, jasmine-like and woody ionone aroma with anise-like, lilac, basil, raspberry and valerian-like undertones. By the same token, blueberry-like, cherry, sweet fruity, fresh raspberry and raspberry kernel-like aroma and taste profiles are highly desirable in improving the flavor and/or aroma of foodstuffs, chewing gums, medicinal products, toothpastes and chewing tobaccos. Fruity and hay-like and sweet notes are desirable in tobacco flavoring compositions and substitute smoking tobacco flavoring compositions in the main stream and the side stream on smoking and prior to smoking.

A limited amount of such materials that give rise to the foregoing properties are available from natural sources, but the natural materials are subject to wide variations in quality, are expensive and are often in critically short supply. In addition, there is continuing search for food flavor compositions which can vary, fortify, modify, enhance, augment or otherwise improve the flavor and/or aroma of foodstuffs, medicinal products, toothpastes and chewing gums. To be satisfactory, such compositions should be stable, non-toxic and blendable with other ingredients to provide their own unique flavor and aroma nuances without detracting from the co-ingredients. Preferably, such compositions should be naturally occurring or present in natural foodstuffs so that their ingestible safety can be readily recognized. These materials should be capable of being synthesized in a simple and economical manner. The need for safe flavors in the berry fruit flavor area especially the raspberry area, winey area, juice area (more especially grape, tea and mimosa) is well known particularly in the ice cream and yogurt flavor areas. More specifically, there is a need for the development of non-toxic materials which can replace natural materials not readily available having blueberry, cherry, sweet fruity, fresh raspberry and raspberry kernel-like aroma and taste nuances.

Compounds defined according to the generic structure:

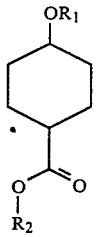

are known in the prior art; but not for their organoleptic utilities. Thus, the compound 4-acetoxycyclohexane carboxylic acid methyl ester is disclosed by Beilstein, E III 10, Syst. Nr. 1053/H 5-6. The compound 4-acetoxycyclohexane carboxylic acid is disclosed by Beilstein, at page 18 of E III 10, Syst. Nr. 1053/H 5-6 at page 19. The compound 4-acetoxycyclohexane carboxylic acid is disclosed by Beilstein, at page 18, of E III 10 Syst. Nr. 1053/H 5-6. 4-Hydroxycyclohexane carboxylic acid itself is also disclosed by Beilstein, at page 18 of E III 10 Syst. Nr. 1053/H 5-6. 4-Hydroxycyclohexane carboxylic acid esters are disclosed in United Kingdom Patent Specification No. 1,114,018 assigned to Asahi Chemical Industry Company Ltd.

4-Hydroxycyclohexane carboxylic esters are also disclosed in Japanese Published Patent Application 75/08077 (abstracted at Chem. Abstract, Vol. 83, 113769q (assigned to Toyobi Company Ltd.).

Nothing in the prior art discloses or infers the organoleptic utilities of the uses of para-acyloxycyclohexyl alkylcarboxylates of our invention.

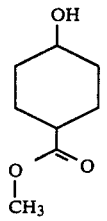

(conditions: Carbowax column programmed at 225° C., isothermal).

Figure 2:
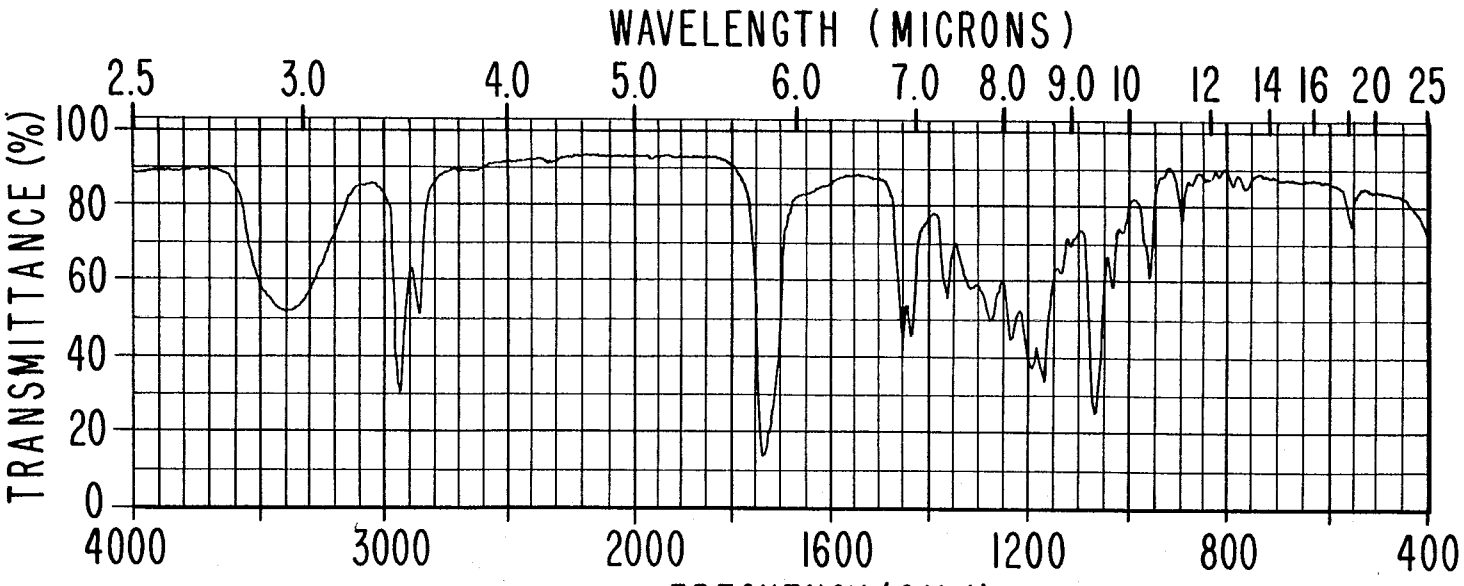

FIG. 2 is the infra-red spectrum for Fraction 28 of the distillation product of the reaction product of Example I containing the compound having the structure:

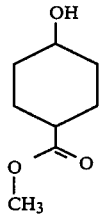

Figure 3:
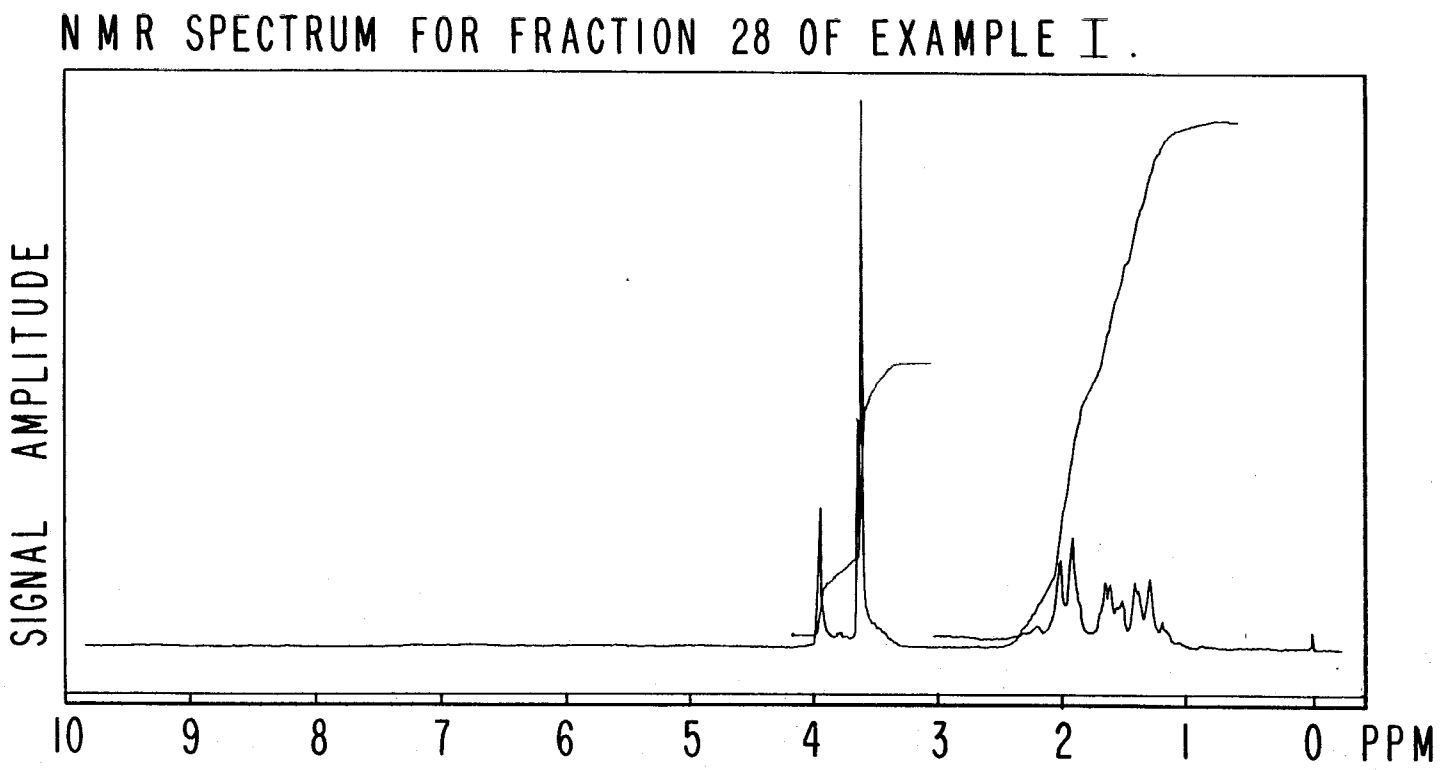

FIG. 3 is the NMR spectrum for Fraction 28 of the distillation product of the reaction product of Example I containing the compound having the structure:

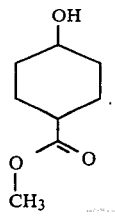

Figure 4:
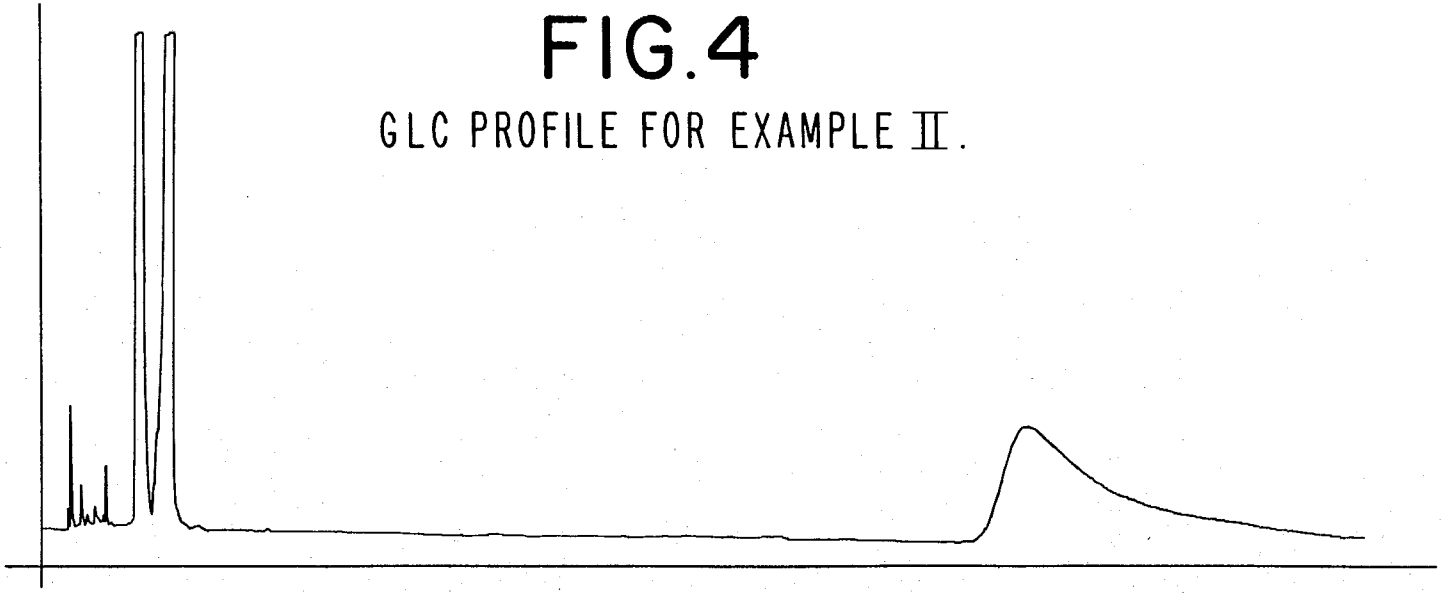

FIG. 4 is the GLC profile for the reaction product of Example II containing the compound having the structure:

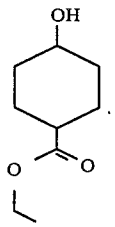

Figure 5:
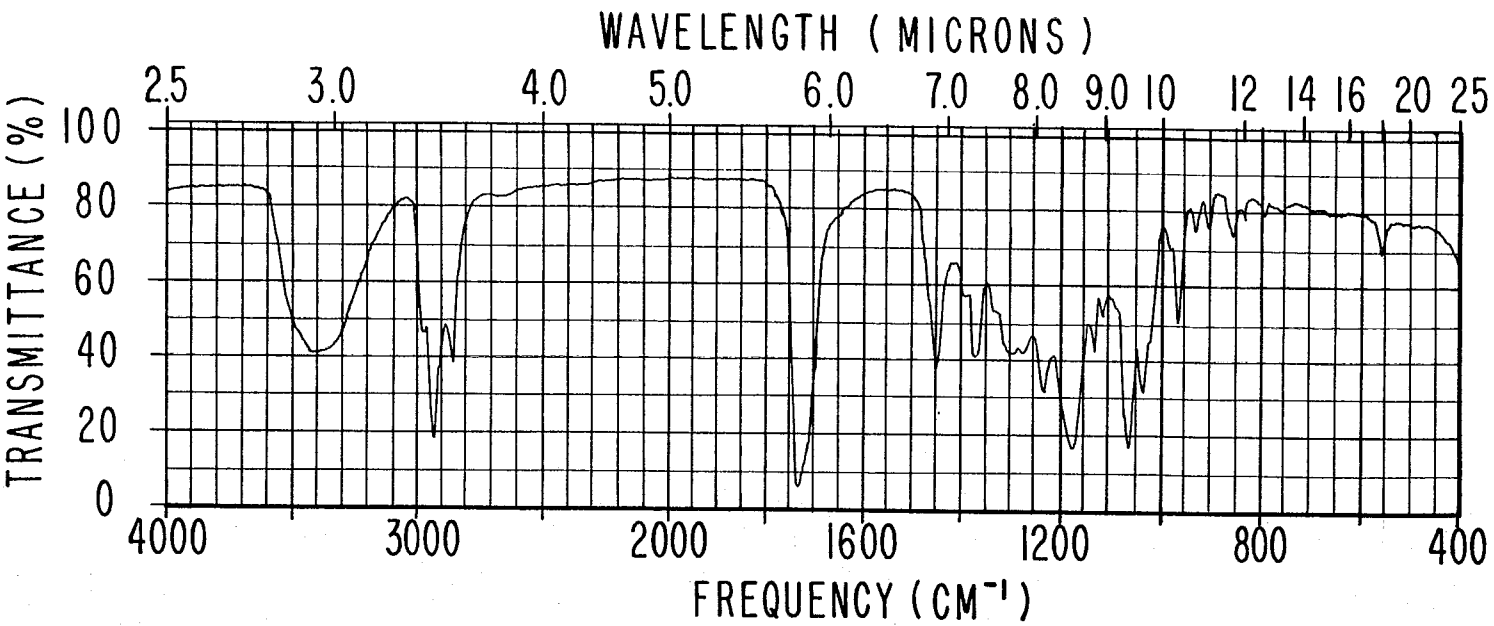

FIG. 5 is the infra-red spectrum for Fraction 14 of the distillation product of the reaction product of Example II containing the compound having the structure:

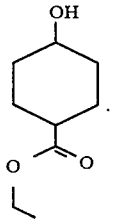

Figure 6:
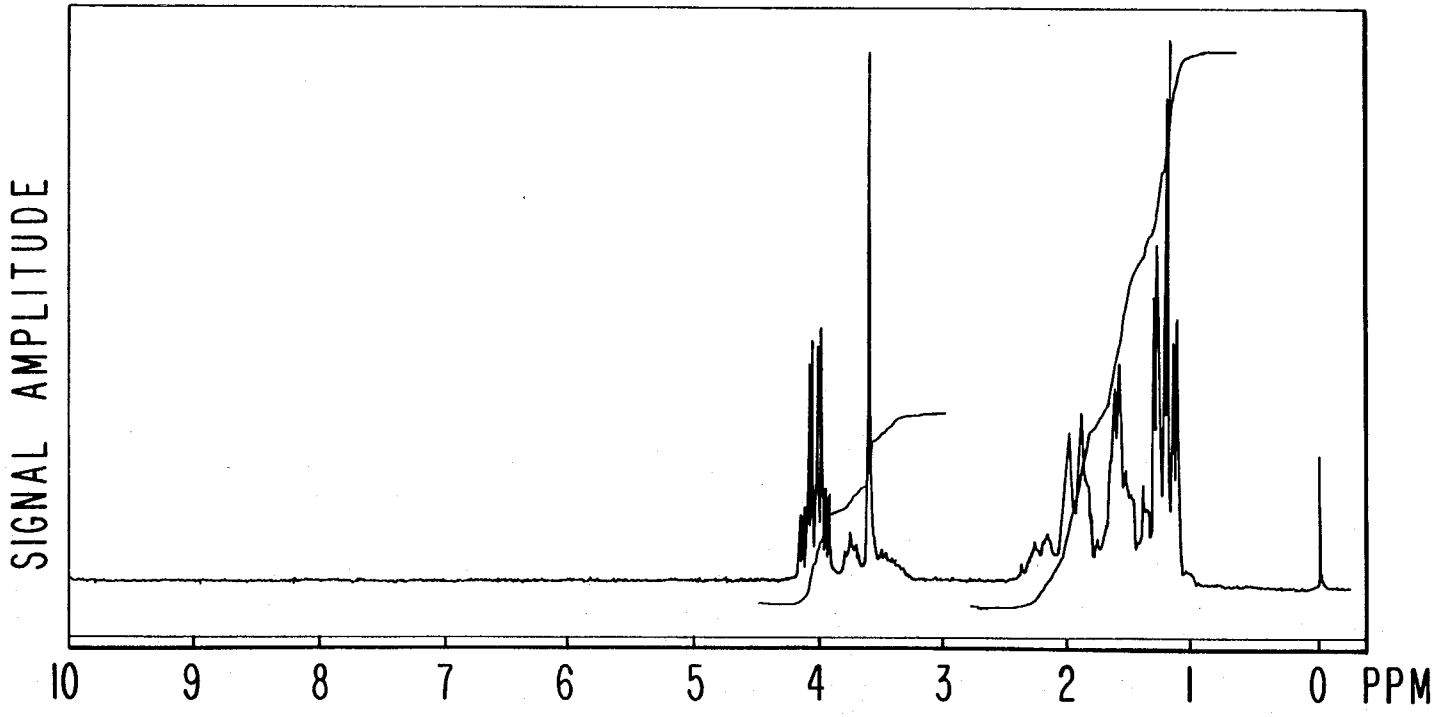

FIG. 6 is the NMR spectrum for Fraction 14 of the distillation product of the reaction product of Example II containing the compound having the structure:

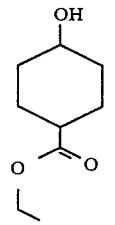

(conditions: Field strength: 100 MHz; Solvent; $CFCl_3$).

Figure 7:
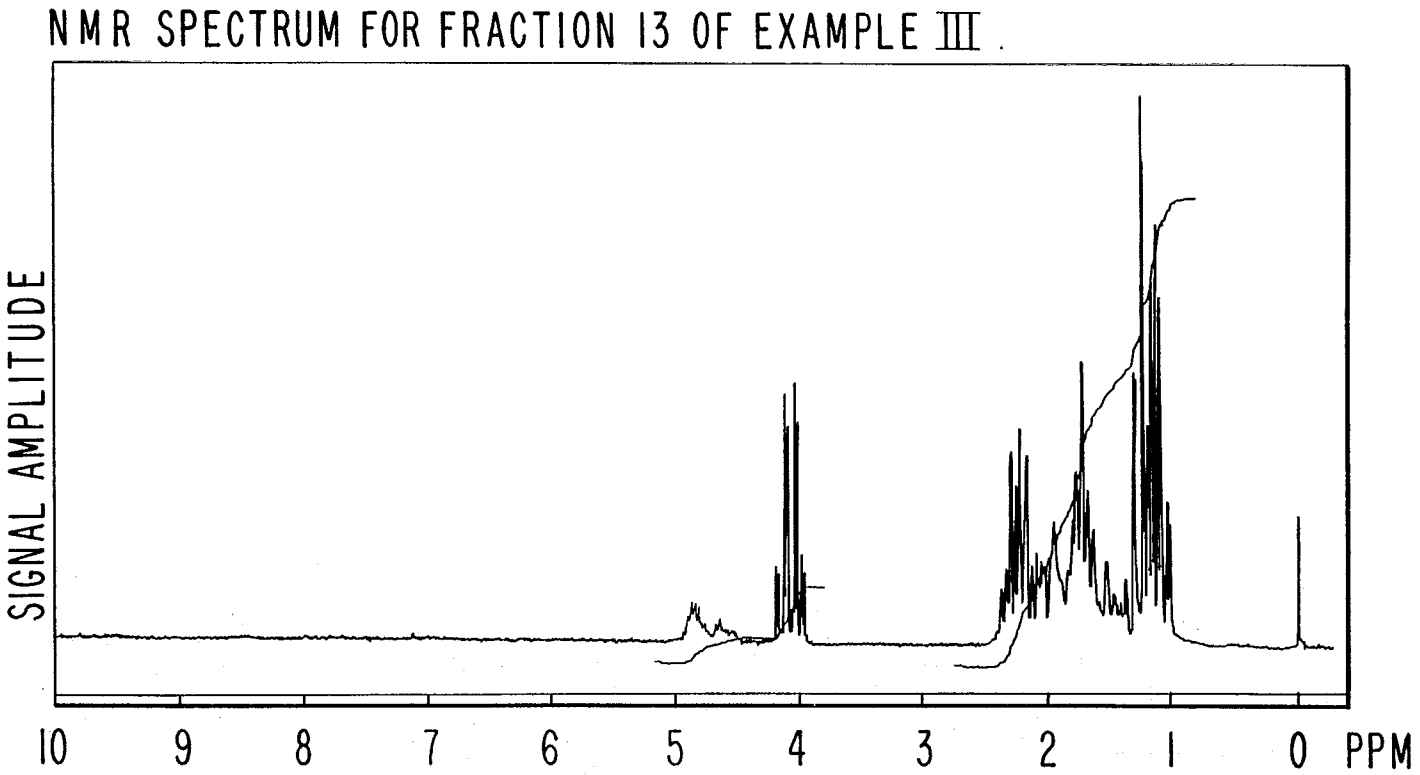

FIG. 7 is the NMR spectrum for Fraction 13 of the distillation product of the reaction product of Example III containing the compound having the structure:

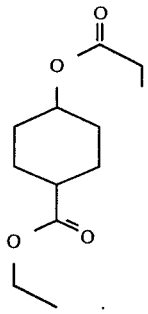

Figure 8:
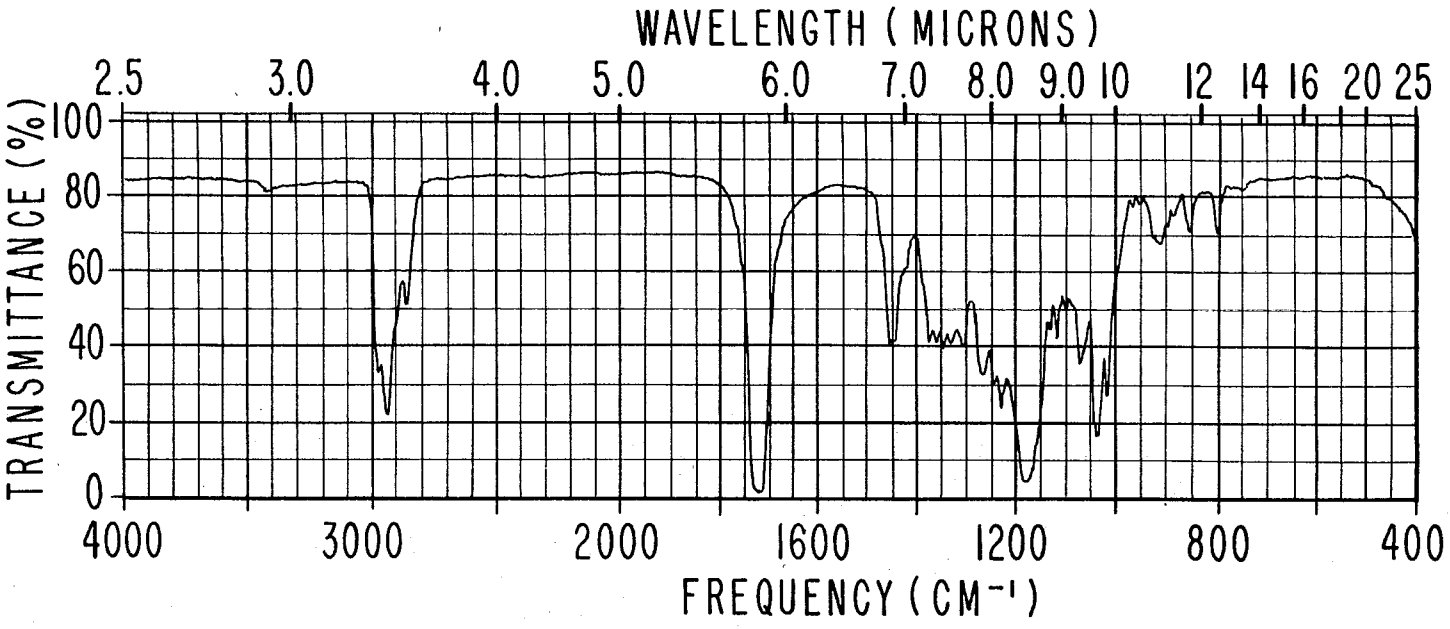

FIG. 8 is the infra-red spectrum for Fraction 13 of the distillation product of the reaction product of Example III containing the compound having the structure:

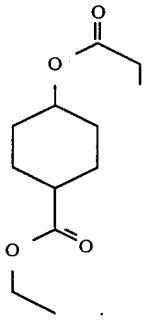

Figure 9:
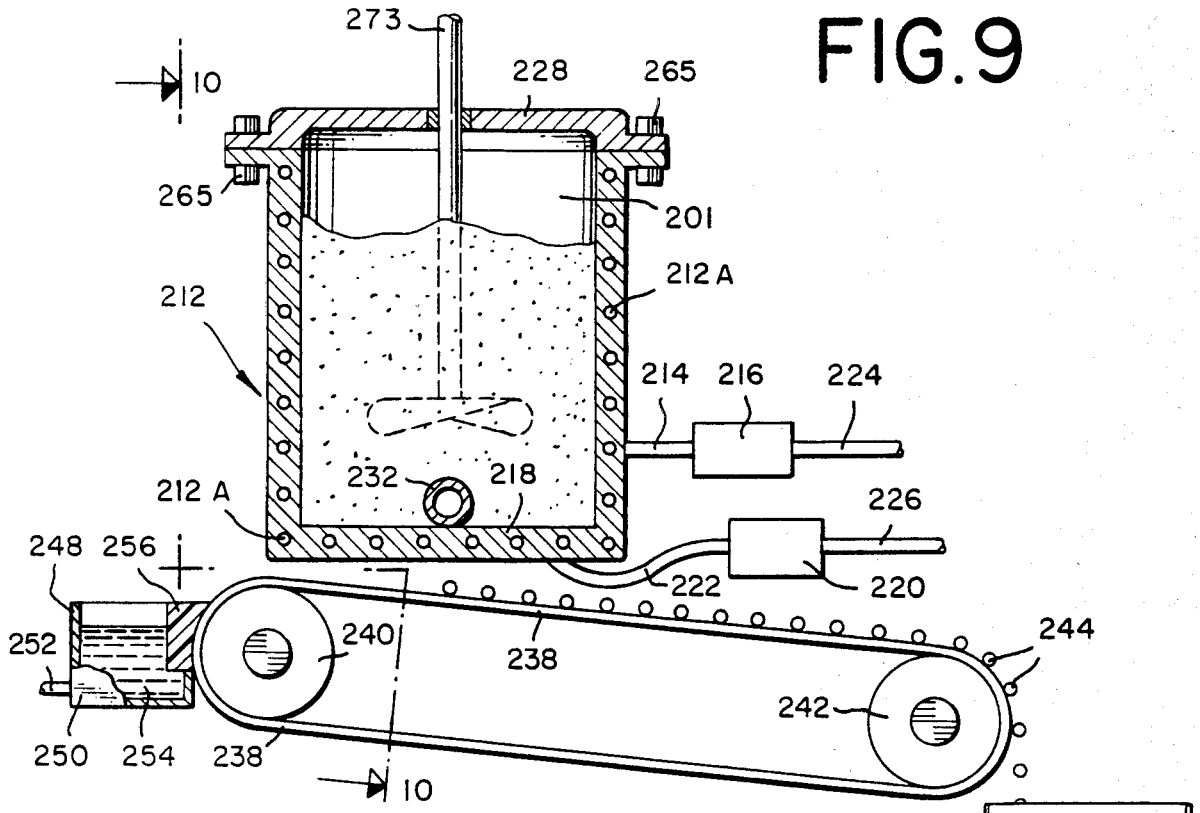

FIG. 9 is a partial side elevation and partial sectional view of an apparatus for forming polymeric pellets scented with at least one of the para-acyloxycyclohexyl alkylcarboxylates of our invention.

Figure 10:
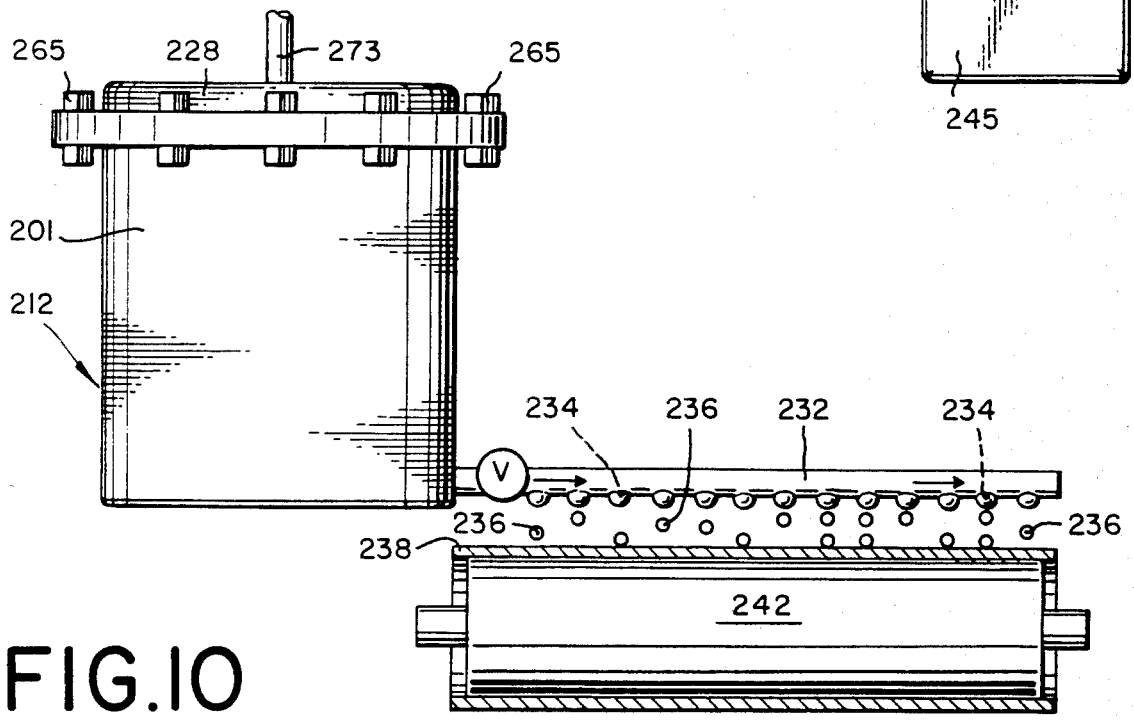

FIG. 10 is a section taken on the line 10—10 of FIG. 9.

DETAILED DESCRIPTION OF THE DRAWINGS

Referring to FIGS. 9 and 10, in particular, the apparatus used in producing polymeric fragrances containing the para-acyloxycyclohexyl alkylcarboxylates of our invention comprises a device forming a scented polyolefin (for example) pellets which comprises a vat or container 2101 into which a mixture of polyolefin such as polyethylene and an aromatic substance or scented material is placed (in this case at least one of the para-acyloxycyclohexyl alkylcarboxylates of our invention). The container is closed by an air-tight lid 228, clamped to the container by bolts 265. A stirrer 273 traverses the lid or cover 228 in air tight manner and is rotated in a suitable manner. A surrounding cycliner 212 having heating coils which are supplied with electric current through cable 224 from a rheostat or control 216 is operated to maintain the temperature inside the container 2101 such that polyethylene or other thermoplastic polymer in the container will be maintained in the molten or liquid state. It has been found advantageous to employ a colorless, odorless polymer (e.g., polyethylene) with a viscosity ranging between 180 and 220 saybolt seconds and having a melting point in the range of 200°–280° F. The heater 2201 is operated to maintain the upper portion of the container 2101 within a temperature range of from 250°–350° F. The bottom portion of the container 218 is heated by means of heating coils 222 heated through a control 220 connected thereto through a connecting wire 226 to maintain a lower portion of the container 218 within a temperature range of from 250°-350° F.

Thus, polymer (e.g., polyethylene) is added to container 2101 and is heated from 10-12 hours whereafter a scented aroma imparting material (at least one of the para-acyloxycyclohexyl alkylcarboxylates of our invention to create the fresh air aroma) is quickly added to the melt. The material must be compatible with polyolefin and forms a homogeneous liquid melt therewith. The scented material is of a type for the particular aroma desired and formulated specifically for the scenting purpose for which the polyolefin will be employed. The heat resisting materials, in some instance in solid or powder form, may be added to the polyolefin in container 2101. Generally, about 10-30% by weight of scenting material (e.g., at least one of the uses of para-acyloxycyclohexyl alkylcarboxylates of our invention) are added to the polyolefin.

After the scent imparting material (e.g., one of the uses of para-acyloxycyclohexyl alkylcarboxylates of our invention) is added to the container 2101, the mixture is stirred for a few minutes for example, 5-15 minutes and maintained within the temperature range as indicated previously by the heating coils 212 and 218, respectively. The controls 216 and 220 are connected through cables 224 and 226 to a suitable power supply of electric current for supplying the power for heating purposes.

Thereafter, the valve "V" is opened permitting the mass to flow outwardly through conduit 232 having a multiplicity of orifices 234 adjacent to the lower side thereof. The outer end of the conduit 232 is closed so that the liquid polymer (e.g., polyolefin) and aroma mixture will continuously drop through orifices 234 downwardly from the conduit 232. During this time, the temperature of the polymer (e.g., polyolefin) and aroma mixture in the container 2101 (e.g., one of the uses of para-acyloxycyclohexyl alkylcarboxylates of our invention) is accurately controlled so that a temperature in the range of from about 210°-275° F. will exit in the conduit 232. The regulation of the temperature through the control 216 and the control 2201 is essential in order to insure temperature balance to provide for the continuous dropping or dripping of molten polymer (e.g., polyethylene) and scenting material (e.g., one or more of uses of para-acyloxycyclohexyl alkylcarboxylates of our invention) mixture through the orifices 234 at a range which will insure the formation of droplets 236 which will fall downwardly onto a moving conveyor belt 238 trained to run between conveyor wheels 240 and 242 beneath the conduit 232.

When the droplets 236 fall onto the conveyor 238 they form pellets 244 which harden almost instantaneously and fall off the end of the conveyor 238 into a container 259 which is advantageously filled with water or some other suitable cooling liquid to insure the rapid cooling of each of the pellets. The pellets 244 are then collected from the container 259 and utilized in process as illustrated infra.

A feature of this aspect of the process of our invention is the provision for moistening the conveyor belt 238 to insure rapid formation of the solid polymer (e.g., polyolefin) scented pellets 244 without sticking to the belt. The belt 238 is advantageously of a material which will not normally stick to a melted plastic but a moistening means 248 insures a sufficiently cold temperature of the belt surface for adequate formation of the pellets 244. The moistening means comprises a container 259 which is continuously fed with water 252 to maintain a level 254 for moistening a sponge element 256 which bears against the exterior surface of the belt 238.

THE INVENTION

The present invention provides uses of para-acyloxycyclohexyl alkylcarboxylates of our invention defined according to the structure:

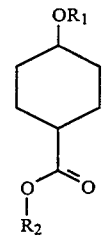

wherein $R_1$ represents hydrogen or $C_2$-$C_4$ acyl and $R_2$ represents $C_1$-$C_3$ alkyl and uses thereof in augmenting or enhancing the aroma or taste of consumable materials including perfume compositions, colognes, and perfumed articles (e.g., solid or liquid anionic, cationic, nonionic or zwitterionic detergents, fabric softener compositions, fabric softener articles, hair preparations, cosmetic powders and the like), foodstuffs chewing gums, toothpastes, chewing tobaccos, medicinal products, smoking tobaccos and smoking tobacco articles. The uses of para-acyloxycyclohexyl alkylcarboxylates of our invention augment or enhance sweet raspberry, strawberry, jasmine-like and woody ionone aromas with anise-like, lilac, basil, and valerian-like undertones in perfume compositions, perfumed articles and colognes. The para-acyloxycyclohexyl alkylcarboxylate of our invention augment or enhance blueberry, cherry, sweet fruity, fresh raspberry and raspberry kernel-like aroma and taste nuances in foodstuffs, chewing gums, chewing tobaccos, medicinal products and toothpastes. The para-acyloxycyclohexyl alkylcarboxylate of our invention also augment or enhance fruity aromatic, turkish tobacco-like aroma and taste nuances both prior to and on smoking in the main stream and the side stream in smoking tobacco compositions and in smoking tobacco article components, e.g., the wrapper, filter and the cyclindrical section of the smoking tobacco itself.

The para-acyloxycyclohexyl alkylcarboxylate of our invention can be produced by first hydrogenating hydroxy benzoic acid esters having the structure:

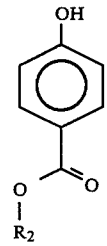

wherein $R_2$ represents $C_1$-$C_3$ alkyl according to the reaction:

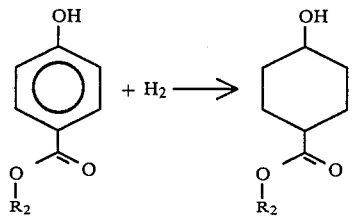

and fractionally distilling the resulting reaction product whereby the hydroxy cyclohexyl carboxylic acid esters are distilled. The resulting distillate can, if desired, then be esterified according to the reaction:

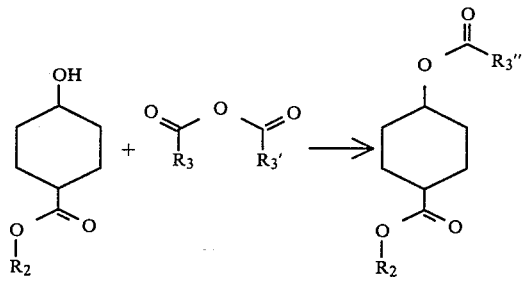

wherein $R_3$ and $R_3'$ are the same or different and each represents $C_1$–$C_3$ alkyl and $R_3''$ represents $R_3$ or $R_3'$. The esterification reaction using the ester having the structure:

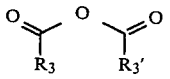

and the hydroxy cyclohexane carboxylic acid ester having the structure:

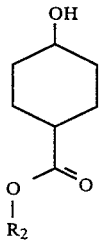

is carried out according to ordinary esterification procedures using standard esterification catalyst such as sulfuric acid phosphoric acid, para-toluene sulphonic acid and the like. The hydrogenation reaction:

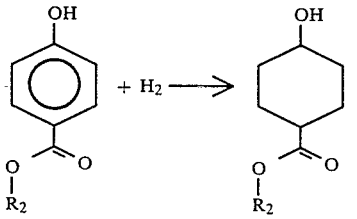

is carried out utilizing standard hydrogenation techniques and a hydrogenation catalyst such as palladium on carbon (e.g., 5–15% palladium on carbon) at temperatures of between 130° and 170° C. and pressures of between 40 and 250 psig.

When the para-acyloxycyclohexyl alkylcarboxylates of our invention are used as food flavor adjuvants, the nature of the co-ingredients included with the para-acyloxycyclohexyl alkylcarboxylates used in formulating the product composition will also serve to alter, modify, augment or enhance the organoleptic characteristics of the ultimate foodstuff treated therewith.

As used herein in regard to flavors, the terms "alter", "modify" and "augment" in their various forms mean "supplying or imparting flavor character or note to otherwise bland, relatively tasteless substances or augmenting the existing flavor characteristic where a natural flavor is deficient in some regard or supplementing the existing flavor impression to modify its quality, character or taste".

The term "enhance" is used herein to mean the intensification of a flavor or aroma characteristic or note without the modification of the quality thereof. Thus, "enhancement" of a flavor or aroma means that the enhancement agent does not add any additional flavor note.

As used herein, the term "foodstuff" includes both solid and liquid ingestible materials which usually do, but need not, have nutritional value. Thus, foodstuffs include soups, convenience foods, beverages, dairy products, candies, chewing gums, vegetables, cereals, soft drinks, snacks and the like.

As used herein, the term "medicinal product" includes both solids and liquids which are ingestible non-toxic materials which have medicinal value such as cough syrups, cough drops, aspirin and chewable medicinal tablets.

The term "chewing gum" is intended to mean a composition which comprises a substantitally water-insoluble, chewable plastic gum base such as chickle, or substitutes therefor, including jelutong, guttakay, rubber or certain comestible natural or synthetic resins or waxes. Incorporated with the gum base in admixture therewith may be plasticizers or softening agents, e.g., glycerine; and a flavoring composition which incorporates the para-acyloxycyclohexyl alkylcarboxylate of our invention, and in addition, sweetening agents which may be sugars, including sucrose or dextrose and/or artificial sweeteners such as cyclamates or saccharin. Other optional ingredients may also be present.

Substances suitable for use herein as co-ingredients or flavoring adjuvants are well known in the art for such use, being extensively described in the relevant literature. It is a requirement that any such material be "ingestibly" acceptable and thus non-toxic and otherwise non-deleterious particularly from an organoleptic standpoint whereby the ultimate flavor and/or aroma of the consumable material used is not caused to have unacceptable aroma and taste nuances. Such materials may in general be characterized as flavoring adjuvants or vehicles comprising broadly stabilizers, thickeners, surface active agents, conditioners, other flavorants and flavor intensifiers.

Stabilizer compounds include preservatives, e.g., sodium chloride; antioxidants, e.g., calcium and sodium ascorbate, ascorbic acid, butylated hydroxy-anisole (mixture of 2- and 3-tertiary-butyl-4-hydroxy-anisole), butylated hydroxy toluene (2,6-di-tertiary-butyl-4-methyl phenol), propyl gallate and the like and sequestrants, e.g., citric acid.

Thickener compounds include carriers, binders, protective colloids, suspending agents, emulsifiers and the like, e.g., agar agar, carrageenan; cellulose and cellulose derivatives such as carboxymethyl cellulose and methyl cellulose; natural and synthetic gums such as gum arabic, gum tragacanth; gelatin, proteinaceous materials; lipids; carbohydrates; starches, pectins and emulsifiers, e.g., mono- and diglycerides of fatty acids, skim milk powder, hexoses, pentoses, disaccharides, e.g., sucrose, corn syrup and the like.

Surface active agents include emulsifying agents, e.g., fatty acids such as capric acid, palmitic acid, myristic acid and the like, mono- and diglycerides of fatty acids, lecithin, defoaming and flavor-dispersing agents such as sorbitan monostearate, potassium stearate, hydrogenated tallow alcohol and the like.

Conditioners include compounds such as bleaching and maturing agents, e.g., benzoyl peroxide, calcium peroxide, hydrogen peroxide and the like; starch modifiers such as peracetic acid, sodium chlorite, sodium hypochlorite, propylene oxide, succinic anhydride and the like, buffers and neutralizing agents, e.g., sodium acetate, ammonium bicarbonate, ammonium phosphate, citric acid, lactic acid, vinegar and the like; colorants, e.g., carminic acid, cochineal, tumeric and curcuma and the like; firming agents such as aluminum sodium sulfate, calcium chloride and calcium gluconate; texturizers, anticaking agents, e.g., aluminum calcium sulfate and tribasic calcium phosphate; enzymes; yeast foods, e.g., calcium lactate and calcium sulfate; nutrient supplements, e.g., iron salts such as ferric phosphate, ferrous gluconate and the like, riboflavin, vitamins, zinc sources such as zinc chloride, zinc sulfate and the like.

Other flavorants and flavor intensifiers include organic acids, e.g., acetic acid, formic acid, 2-hexenoic acid, benzoic acid, n-butyric acid, caproic acid, caprylic acid, cinnamic acid isobutyric acid, isovaleric acid, alpha-methylbutyric acid, propionic acid, valeric acid, 2-methyl-2-pentenoic acid and 2-methyl-3-pentenoic acid; ketones and aldehydes, e.g., acetaldehyde, acetophenone, acetone, acetyl methyl carbinol, acrolein, n-butanal, crotonal, diacetyl, 2-methyl butanal, beta, beta-dimethylacrolein, methyl-n-amyl ketone, n-hexenal, 2-hexenal, isopentanal, hydrocinnamic aldehyde, cis-3-hexenal, 2-heptanal, nonyl aldehyde, 4-(p-hydroxyphenyl)-2-butanone, alpha-ionone, beta-ionone, methyl-3-butanone, benzaldehyde, damascone, damascenone, acetophenone, 2-heptanone, o-hydroxyacetophenone, 2-methyl-2-hepten-6-one, 2-octanone, 2-undecanone, 3-phenyl-4-pentenal, 2-phenyl-2-hexenal, 2-phenyl-2-pentenal, furfural, 5-methyl furfural, cinnamaldehyde, beta-cyclohomocitral, 2-pentanone, 2-pentenal and propanal; alcohols such as 1-butanol, benzyl alcohol, 1-borneol, trans-2-buten-1-ol, ethanol, geraniol, 1-hexanal, 2-heptanol, trans-2-hexenol-1, cis-3-hexen-1-ol, 3-methyl-3-buten-1-ol, 1-pentanol, 1-penten-3-ol, p-hydroxyphenyl-2-ethanol, isoamyl alcohol, isofenchyl alcohol, phenyl-2-ethanol, alpha-terpineol, cis-terpineol hydrate, eugenol, linalool, 2-heptanol, acetoin; esters, such as butyl acetate, ethyl acetate, ethyl acetoacetate, ethyl benzoate, ethyl butyrate, ethyl caprate, ethyl caproate, ethyl caprylate, ethyl cinnamate, ethyl crotonate, ethyl formate, ethyl isobutyrate, ethyl isovalerate, ethyl laurate, ethyl myrsitate, ethyl alpha-methylbutyrate, ethyl propionate, ethyl salicylate, trans-2-hexenyl acetate, hexyl acetate, 2-hexenyl butyrate, hexyl butyrate, isoamyl acetate, isopropyl butyrate, methyl acetate, methyl butyrate, methyl caproate, methyl isobutyrate, alpha-methylphenylglycidate, ethyl succinate, isobutyl cinnamate, cinnamyl formate, methyl cinnamate and terpenyl acetate; hydrocarbons such as dimethyl naphthalene, dodecane, methyl diphenyl, methyl naphthalene, myrcene, naphthalene, octadecane, tetradecane, tetramethyl naphthalene, tridecane, trimethyl naphthalene, undecane, caryophylene, 1-phellandrene, p-cymene, 1-alphapinene; pyrazines such as 2,3-dimethylpyrazine, 2,5-dimethylpyrazine, 2,6-dimethylpyrazine, 3-ethyl-2,5-dimethylpyrazine, 2-ethyl-3,5,6-trimethylpyrazine, 3-isoamyl-2,5-dimethylpyrazine, 5-isoamyl-2,3-dimethylpyrazine, 2-isoamyl-3,5,6-trimethylpyrazine, isopropyl dimethylpyrazine, methyl ethylpyrazine, tetramethylpyrazine, trimethylpyrazine; essential oils, such as jasmine absolute, cassia oil, cinnamon bark oil, rose absolute, orris absolute, lemon essential oil, Bulgarian rose, yara yara and vanilla; lactones such as δ-nonalactone; sulfides, e.g., methyl sulfide and other materials such as maltol, acetoin and acetals (e.g., 1,1-diethoxyethane, 1,1-dimethoxyethane and dimethoxymethane).

The specific flavoring adjuvant selected for use may be either solid or liquid depending upon the desired physical form of the ultimate product, i.e., foodstuff, whether simulated or natural, and should, in any event, (i) be organoleptically compatible with the para-acyloxycyclohexyl alkylcarboxylate of our invention by not covering or spoiling the organoleptic properties (aroma and/or taste) thereof; (ii) be non-reactive with the para-acyloxycyclohexyl alkylcarboxylate of our invention and (iii) be capable of providing an environment in which the para-acyloxycyclohexyl alkylcarboxylate of our invention can be dispersed or admixed to provide a homogeneous medium. In addition, selection of one or more flavoring adjuvants, as well as the quantities thereof will depend upon the precise organoleptic character desired in the finished product. Thus, in the case of flavoring compositions, ingredient selection will vary in accordance with the foodstuff, chewing gum, medicinal product or toothpaste to which the flavor and/or aroma are to be imparted, modified, altered or enhanced. In contradistinction, in the preparation of solid products, e.g., simulated foodstuffs, ingredients capable of providing normally solid compositions should be selected such as various cellulose derivatives.

As will be appreciated by those skilled in the art, the amount of the para-acyloxycyclohexyl alkylcarboxylate employed in a particular instance can vary over a relatively wide range, depending upon the desired organoleptic effects to be achieved. Thus, correspondingly greater amounts would be necessary in those instances wherein the ultimate food composition to be flavored is relatively bland to the taste, whereas relatively minor quantities may suffice for purposes of enhancing the composition merely deficient in natural flavor or aroma. The primary requirement is that the amount selected be effective, i.e., sufficient to alter, modify or enhance the organoleptic characteristics of the parent composition, whether foodstuff per se, chewing gum per se, medicinal product per se, toothpaste per se, or flavoring composition.

The use of insufficient quantities of the para-acyloxycyclohexyl alkylcarboxylate will, of course, substantially vitiate any possibility of obtaining the desired results while excess quantities prove needlessly costly and in extreme cases, may disrupt the flavor-aroma balance, thus proving self-defeating. Accordingly, the terminology "effective amount" and "sufficient amount" is to be accorded a significance in the context of the present invention consistent with the obtention of desired flavoring effects.

Thus, and with respect to ultimate food compositions, chewing gum compositions, medicinal product compositions and toothpaste compositions, it is found that quantities of para-acyloxycyclohexyl alkylcarboxylate ranging from a small but effective amount, e.g., 0.5 parts per million up to about 100 parts per million based on total composition are suitable. Concentrations in excess of the maximum quantity stated are not normally recommended, since they fail to prove commensurate enhancement of organoleptic properties. In those instances wherein the para-acyloxycyclohexyl alkylcarboxylate are added to the foodstuff as an integral component of a flavoring composition, it is, of course, essential that the total quantity of flavoring composition employed be sufficient to yield an effective concentration of para-acyloxycyclohexyl alkylcarboxylate in the foodstuff product.

Food flavoring compositions prepared in accordance with the present invention preferably contain the para-acyloxycyclohexyl alkylcarboxylate in concentrations ranging from about 0.1% up to about 15% by weight based on the total weight of the said flavoring composition.

The compositions described herein can be prepared according to conventional techniques well known as typified by cake batters and fruit drinks and can be formulated by merely admixing the involved ingredients within the proportions stated in a suitable blender to obtain the desired consistency, homogeneity of dispersion, etc. Alternatively, flavoring compositions in the form of particulate solids can be conveniently prepared by mixing para-acyloxycyclohexyl alkylcarboxylate with, for example, gum arabic, gum tragacanth, carrageenan and the like, and thereafter spray-drying the resultant mixture whereby to obtain the particulate solid product. Pre-prepared flavor mixes in powder form, e.g., a fruit-flavored powder mix are obtained by mixing the dried solid components, e.g., starch, sugar and the like and para-acyloxycyclohexyl alkylcarboxylate in a dry blender until the requisite degree of uniformity is achieved.

It is presently preferred to combine with the para-acyloxycyclohexyl alkylcarboxylate of our invention, the following adjuvants:

p-Hydroxybenzyl acetone;
Geraniol;
Cassia Oil;
Acetaldehyde;
Maltol;
Ethyl methyl phenyl glycidate;
Benzyl acetate;
Dimethyl sulfide;
Eugenol;
Vanillin;
Caryophyllene;
Methyl cinnamate;
Guiacol;
Ethyl pelargonate;
Cinnamaldehyde;
Methyl Anthranilate;
5-Methyl furfural;
Isoamyl acetate;
Isobutyl acetate;
Cuminaldehyde;
Alpha ionone;
Cinnamyl formate;
Ethyl butyrate;
Methyl cinnamate;
Acetic acid;
Gamma-undecalactone;
Naphthyl ethyl ether;
Diacetyl;
Furfural;
Ethyl acetate;
Anethole;
2,3-Dimethyl pyrazine;
2-Ethyl-3-methyl pyrazine;
3-Phenyl-4-pentenal;
2-Phenyl-2-hexenal;
2-Phenyl-2-pentenal;
3-Phenyl-4-pentenal diethyl acetal;
β-Damascone (1-crotonyl-2,2,6-trimethylcyclohex-1-ene);
β-Damascenone (1-crotonyl-2,2,6-trimethylcyclohexa-1,3-diene);
Beta-cyclohomocitral (2,2,6-trimethylcyclohex-1-ene carboxaldehyde);
Isoamyl butyrate;
Cis-3-hexenol-1;
2-Methyl-2-pentenoic acid;
Elemecine (4-allyl-1,2,6-trimethoxybenzene);
Isoelemecine (4-propenyl-1,2,6-trimethoxybenzene); and
2-(4-Hydroxy-4-methylpentyl)norbornadiene.

The para-acyloxycyclohexyl alkylcarboxylate of our invention and one or more auxiliary perfume ingredients, including for example, alcohols, aldehydes, ketones, terpinic hydrocarbons, nitriles, esters, other than the para-acyloxycyclohexyl alkylcarboxylate of our invention lactones, natural essential oils and synthetic essential oils, may be admixed so that the combined odors of the individual components produce a pleasant and desired fragrance, particularly and preferably in rose and lilac fragrances. Such perfume compositions usually contain (a) the main note or the "bouquet" or foundation stone of the composition; (b) modifiers which round off and accompany the main note; (c) fixatives which include odorous substances which lend a particular note to the perfume throughout all stages of evaporation and substances which retard evaporation; and (d) topnotes which are usually low boiling fresh smelling materials.

In perfume compositions, it is the individual components which contribute to their particular olfactory characteristics, however the over-all sensory effect of the perfume composition will be at least the sum total of the effects of each of the ingredients. Thus, para-acyloxycyclohexyl alkylcarboxylate can be used to alter, modify or enhance the aroma characteristics of a perfume composition, for example, by utilizing or moderating the olfactory reaction contributed by another ingredient in the composition.

The amount of para-acyloxycyclohexyl alkylcarboxylate of our invention which will be effective in perfume compositions as well as in perfumed articles and colognes depends on many factors, including the other ingredients, their amounts and the effects which are desired. It has been found that perfume compositions containing as little as 0.01% of para-acyloxycyclohexyl alkylcarboxylate or even less (e.g., 0.005%) can be used to impart a sweet raspberry-like, strawberry-like, jasmine-like, woody, ionone-like note to soaps, cosmetics or other products. The amount employed can range up to 70% of the fragrance components and will depend on considerations of cost, nature of the end product, the effect desired on the finished product and the particular fragrance sought.

The para-acyloxycyclohexyl alkylcarboxylate of our invention is useful [taken alone or together with other ingredients in perfume compositions] as (an) olfactory component(s) in detergents and soaps, space odorants and deodorants, perfumes, colognes, toilet water, bath preparations, such as creams, deodorants, hand lotions and sun screens; powders, such as talcs, dusting powders, face powders and the like. When used as (an) olfactory component(s) as little as 1% of the para-acyloxycyclohexyl alkylcarboxylate or composition containing a high proportion of para-acyloxycyclohexyl alkylcarboxylate and less than 50% of para-acyloxycyclohexyl alkylcarboxylate will suffice to impart an intense sweet raspberry, strawberry, jasmine-like, woody, ionone aromas with anise-like, lilac, basil, raspberry and valerian oil-like undertones.

In addition, the perfume composition or fragrance composition of our invention can contain a vehicle, or carrier of para-acyloxycyclohexyl alkylcarboxylate or composition containing a high proportion of para-acyloxycyclohexyl alkylcarboxylate. The vehicle can be a liquid such as an alcohol, a non-toxic alcohol, a non-toxic glycol, or the like. The carrier can also be an absorbent solid, such as a gum (e.g., gum arabic) or components for encapsulating the composition (such as gelatin).

It will thus be apparent that the para-acyloxycyclohexyl alkylcarboxylate or composition containing a high proportion of para-acyloxycyclohexyl alkylcarboxylate and less than 50% of para-acyloxycyclohexyl alkylcarboxylate of our invention can be utilized to alter, modify or enhance sensory properties, particularly organoleptic properties, such as flavor(s) and/or fragrance(s) of a wide variety of consumable materials.

The following Examples I and III serve to illustrate methods of producing para-acyloxycyclohexyl alkylcarboxylate of our invention. The following Example IV, et seq serve to illustrate their organoleptic utilities of the para-acyloxycyclohexyl alkylcarboxylate of our invention.

All parts and percentages given herein are by weight unless otherwise specified.

EXAMPLE I

Preparation of 4-Carbomethoxy Cyclohexanol

Reaction:

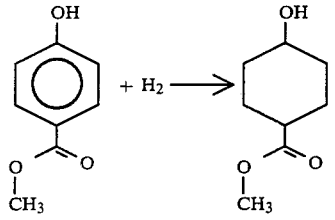

Into a 1-liter magnetically stirred autoclave, methyl p-hydroxybenzoate (488 grams) and 5% palladium on carbon (2.5 grams) is placed. The reaction mass is hydrogenated at 125°–130° C. and 50–70 psig hydrogen pressure. After eighteen hours GLC analysis indicates that 66% ketone and 31% alcohols is formed. The resulting reaction mass is cooled, filtered and distilled through an eight plate vigreux column yielding the following fractions:

| Fraction No. | Vapor Temp. (°C.) | Liquid Temp. (°C.) | Vacuum mm/Hg. Pressure | Weight of Fraction (gms) |
|---|---|---|---|---|
| 1–12 | 87 | 123 | 3.4/2.8 | 178.9 |
| 13–16 | 85 | 143 | 2.3 | 72.1 |
| 17–18 | 87 | 138 | 2.3 | 37.4 |
| 19 | 87 | 141 | 2.3 | 15.0 |
| 20 | 91 | 146 | 2.3 | 16.1 |
| 21–24 | 92 | 163 | 2.3 | 47.0 |
| 25–27 | 93 | 176 | 2.3 | 36.1 |
| 28–30 | 104 | 198 | 2.3 | 11.4 |

Fractions 25–27 are bulked and these fractions consist of the compound defined according to the structure:

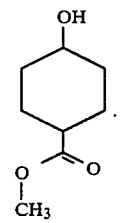

Figure 1:
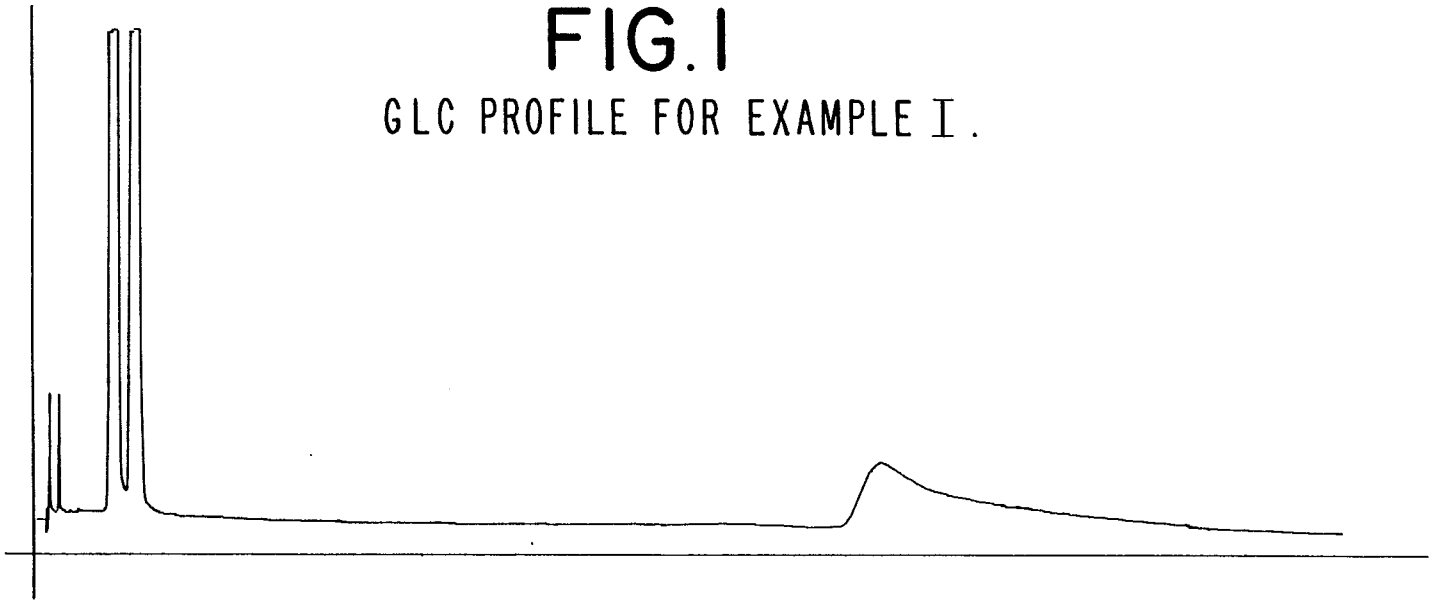
FIG. 1 is the GLC profile for the reaction product of Example I containing the compound having the structure.

FIG. 1 is the GLC profile for the crude reaction product (conditions: 10′×0.25″, 10% carbowax column programmed at 225° C. isothermal).

FIG. 2 is the infra-red spectrum for Fraction 28 of the foregoing distillation.

FIG. 3 is the NMR spectrum for Fraction 28 of the foregoing distillation (conditions: Field strength: 100 MHz; Solvent: $CFCl_3$).

The compound having the structure:

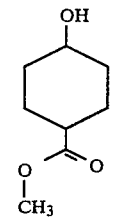

has a sweet raspberry and strawberry aroma with anise-like, lilac and basil nuances on dry-out from a perfumery standpoint and blueberry, cherry and sweet fruity aroma and taste profile at 5 ppm from a flavor standpoint.

EXAMPLE II

Preparation of 4-Carboethoxy Cyclohexanol

Reaction:

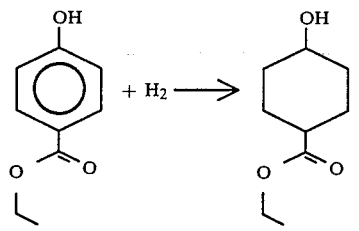

Into an autoclave is placed ethyl-p-hydroxybenzoate (495 grams) and 5% palladium on carbon (4 grams). The reaction mass is hydrogenated at 150° C. and 50–75 psig hydrogen pressure. After five hours, a sample showed 40% ketone and 44% alcohol having the structure:

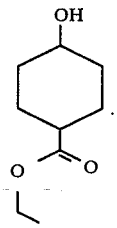

The reaction mass is cooled, filtered and distilled through an eight plate vigreux column yielding the following fractions:

| Fraction No. | Vapor Temp. (°C.) | Liquid Temp. (°C.) | Vacuum mm/Hg. Pressure | Weight of Fraction (gms) |
|---|---|---|---|---|
| 1–2 | 72–78 | 120/126 | 2.4 | 20.9 |
| 3–6 | 82–84 | 124 | 2.5 | 67.3 |
| 7–9 | 84 | 124–130 | 2.5 | 97.6 |
| 10–11 | 84–105 | 130–153 | 2.5 | 36.7 |
| 12 | 105 | 153 | 2.5 | 12.2 |
| 13–14 | 105–108 | 158–184 | 2.5 | 17.6 |
| 15–16 | 115 | 220 | 2.5 | 10.1 |

FIG. 4 is the GLC profile for the crude material prior to distillation (conditions: 10% carbowax 10′×0.25″ column programmed at 225° C. isothermal).

FIG. 5 is the infra-red spectrum for Fraction 14 of the foregoing distillation.

FIG. 6 is the NMR spectrum for Fraction 14 of the foregoing distillation containing the compound having the structure:

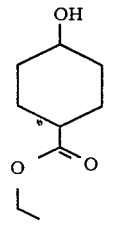

(conditions: Field strength: 100 MHz; Solvent: $CFCl_3$).

The compound having the structure:

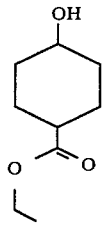

has a raspberry-like and jasmine-like aroma with raspberry and valerian oil-like nuances on dry-out from a perfumery standpoint. From a flavor standpoint, it has a fresh raspberry aroma and taste at 2 ppm.

EXAMPLE III

Preparation of 4-Propionoxy-Cyclohexane Carboxylic Acid, Ethyl Ester

Reaction:

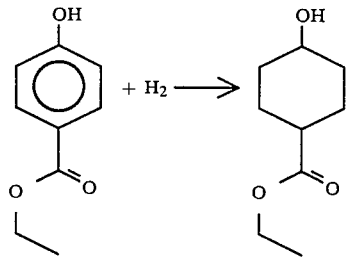

and

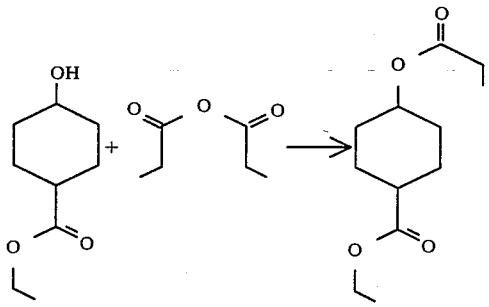

289 Grams of ethyl-p-hydroxybenzoate and 4 grams of 5% palladium on carbon are charged to a 1-liter magnetically stirred autoclave. The material is hydrogenated at 125°–140° C. and 50 psig hydrogen pressure. Hydrogenation is continued until the uptake is approximately 70% of theory. GLC analysis indicates that the reaction mass is now 71% ketone and 7.6% alcohol. The reaction product is cooled, diluted with isopropyl alcohol, filters. The isopropyl alcohol is removed by stripping and the remainder is distilled through a short column. 286 Grams of the resulting distillate is admixed with 75 grams of propionicanhydride at 100° C. for a period of four hours. The resulting material is washed until neutral and distilled through an eight plate vigreux column yielding the following fractions:

| Fraction No. | Vapor Temp. (°C.) | Liquid Temp. (°C.) | Vacuum mm/Hg. Pressure | Weight of Fraction (gms) |
|---|---|---|---|---|
| 1–2 | 72–78 | 120/126 | 2.4 | 20.9 |

-continued

| Fraction No. | Vapor Temp. (°C.) | Liquid Temp. (°C.) | Vacuum mm/Hg. Pressure | Weight of Fraction (gms) |
|---|---|---|---|---|
| 3–6 | 82–84 | 124 | 2.5 | 67.3 |
| 7–9 | 84 | 124–130 | 2.5 | 97.6 |
| 10–11 | 84–105 | 130–153 | 2.5 | 36.7 |
| 12 | 105 | 153 | 2.5 | 12.2 |
| 13–14 | 105–108 | 158–184 | 2.5 | 17.6 |
| 15–16 | 115 | 220 | 2.5 | 10.1 |

Fraction 13–16 are bulked and NMR and IR analysis indicate that this bulking consists of the compound defined according to the structure:

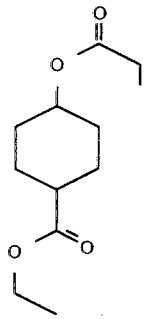

FIG. 7 is the NMR spectrum for Fraction 13 of the foregoing distillation containing the compound having the structure:

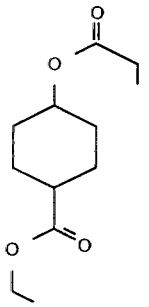

(conditions: Field strength: 100 MHz; Solvent: $CFCl_3$).

FIG. 8 is the infra-red spectrum for Fraction 13 of the foregoing distillation containing the compound having the structure:

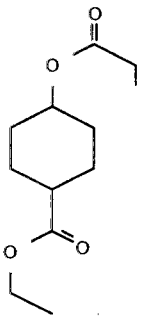

The resulting compound having the structure:

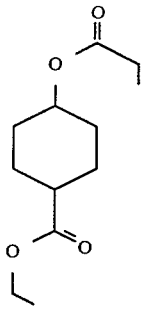

has a woody ionone aroma from a fragrance standpoint and a raspberry kernel aroma and taste at 0.5 ppm.

EXAMPLE IV

Floral, Rose Perfume Compositions

The following mixtures are prepared:

| Ingredients | Parts By Weight IV(A) | IV(B) | IV(C) |
|---|---|---|---|
| Rhodinol | 250 | 250 | 250 |
| Phenylethyl alcohol | 195 | 195 | 195 |
| Alpha methyl ionone | 80 | 80 | 80 |
| Linalyl acetate | 60 | 60 | 60 |
| Cis-3-hexenyl acetate | 5 | 5 | 5 |
| Jasmine absolute | 10 | 10 | 10 |
| Cinnamic alcohol | 20 | 20 | 20 |
| Rhodinyl acetate | 60 | 60 | 60 |
| Cyclohexyl ethyl alcohol | 20 | 20 | 20 |
| Geraniol | 130 | 130 | 130 |
| Geranyl acetate | 80 | 80 | 80 |
| Paraisopropyl cyclohexanol | 80 | 80 | 80 |
| Diethyl phthalate | 30 | 30 | 30 |
| Compound having the structure: 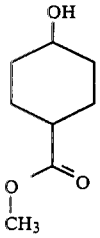 produced according to Example I. | 30 | 0 | 0 |
| Compound having the structure: 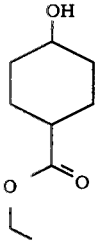 produced according to Example IV(B). | 0 | 30 | 0 |
| Compound having the structure: | 0 | 0 | 30 |

-continued

| Ingredients | Parts By Weight IV(A) | IV(B) | IV(C) |
|---|---|---|---|
| 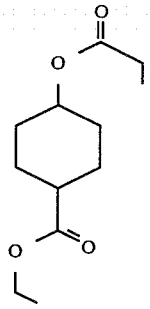 produced according to Example III. | | | |

The resulting fragrance compositions are described as follows:

| | |
|---|---|
| Example IV(A) | A fresh floral aroma with sweet raspberry-like and strawberry-like topnotes and anise-like, lilac and basil undertones. |
| Example IV(B) | A fresh rose aroma with jasmine-like topnotes and raspberry-like and valerian-like undertones. |
| Example IV(C) | A fresh rose aroma with woody ionone topnotes. |

EXAMPLE V

Preparation of a Cosmetic Powder Composition

A cosmetic powder is prepared by mixing in a ball mill, 100 grams of talcum powder with 0.25 grams of one of the perfumery substances set forth in Table I below. Each of the cosmetic powders has an excellent intense aroma as set forth in Table I below:

TABLE I

| Perfume Substance | Perfumery Evaluation |
|---|---|
| Compound having the structure: 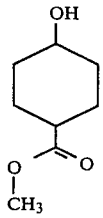 produced according to Example I. | A sweet raspberry, strawberry aroma with anise-like, lilac and basil nuances on dry-out. |
| Compound having the structure: 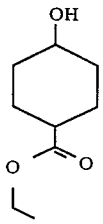 produced according to Example II. | A raspberry-like, jasmine-like aroma with raspberry and valerian oil-like nuances on dry-out. |

TABLE I-continued

| Perfume Substance | Perfumery Evaluation |
|---|---|
| Compound having the structure: 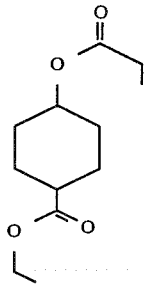 produced according to Example III. | A woody ionone aroma. |
| Perfume composition of Example IV(A) | A fresh floral aroma with sweet raspberry-like and strawberry-like topnotes and anise-like, lilac and basil undertones. |
| Perfume composition of Example IV(B) | A fresh rose aroma with jasmine-like topnotes and raspberry-like and valerian-like undertones. |
| Perfume composition of Example IV(C) | A fresh rose aroma with woody ionone topnotes. |

EXAMPLE VI

Perfumed Liquid Detergent

Concentrated liquid detergents with aromas as set forth in Table I of Example V (which detergents are prepared from Lysine salt of n-dodecyl benzene sulfonic acid as more specifically described in U.S. Pat. No. 3,948,818 issued on Apr. 6, 1976 the specification for which is incorporated by reference herein) are prepared containing each of the substances set forth in Table I of Example V, supra. They are prepared by adding and homogeneously mixing the appropriate quantity of perfumery substance as set forth in Table I of Example V in the liquid detergent. The detergents all possess aromas as set forth in Table I of Example V, the intensity increasing with greater concentrations of perfumery substance of Table I of Example V, supra.

EXAMPLE VII

PREPARATION OF A COLOGNE AND HANDKERCHIEF PERFUME

The perfume substances of Table I of Example V, supra are incorporated into colognes at concentrations of 1.5%, 2.0%, 2.5%, 3.0% and 4.0% in 80%, 85% and 90% aqueous ethanols; and into a handkerchief perfume compositions at concentrations of 10%, 15%, 20%, 25% and 30% (in 85%, 90% and 95% aqueous ethanols). Distinct and definitive aromas as set forth in Table I of Example V are imparted to the cologne and to the handkerchief perfume compositions.

EXAMPLE VIII

Preparation of a Detergent Composition

A total of a 100 glrams of a detergent powder (a non-ionic detergent powder containing a proteo lytic enzyme prepared according to Example I of Canadian Letters Patent No. 985,190 issued on Mar. 9, 1976 the disclosure of which is incorporated by reference herein) is mixed with 0.15 grams of each of the substances set forth in Table I of Example V, supra until substantially homogeneous compositions are obtained. These compositions have excellent aromas as set forth in Table I of Example V.

EXAMPLE IX

Preparation of Soap

Each of the perfumery substances of Table I of Example V are incorporated into soap (LVU-1) at 0.1% by weight of each substance. After two weeks in the oven at 90° F. each of the soaps showed no visual effect from the heat. Each of the soaps manifested an excellent aroma as set forth in Table I of Example V, supra.

EXAMPLE X

Preparation of Soap Composition

One hundred grams of soap chips (IVORY ®, registered trademark of the Procter & Gamble Co. of Cincinnati, Ohio) are mixed individually with one gram each of the perfumery substances of Table I of Example V, supra until a homogeneous composition is obtained. The homogeneous composition is then treated under three atmospheres pressure at 180° C. for a period of three hours and the resulting liquid is placed into a soap mold. The resulting soap cakes, on cooling, manifest excellent aromas as set forth in Table I of Example V, supra.

EXAMPLE XI

Preparation of a Solid Detergent Composition

A detergent is prepared from the following ingredients according to Example I of Canadian Letters Patent No. 1,007,948 the specification for which is incorporated by reference herein):

| Ingredients | Parts by Weight |
|---|---|
| "Neodol 45-II" (a $C_{14}$–$C_{15}$ alcohol ethoxylated with 11 moles of ethylene oxide) | 12 |
| Sodium carbonate | 55 |
| Sodium citrate | 20 |
| Sodium sulfate, water brighteners | q.s. |

This detergent is a "phosphate-free" detergent. A total of 100 grams of this detergent is admixed separately with 0.15 grams of each of the perfume substances of Table I of Example V, supra. The detergent samples each have excellent aromas as set forth in Table I of Example V, supra.

EXAMPLE XII

Utilizing the procedure of Example I at column 15 of U.S. Pat. No. 3,632,396 the specification for which is incorporated by reference herein), a non-woven cloth substrate useful as a dryer-added fabric softening article of manufacture is prepared wherein the substrate, the substrate coating and the outer coating and the perfuming material are as follows:

1. a water "dissolvable" paper ("Dissolvo Paper");
2. Adogen 448 (m.p. about 140° F.) as the substrate coating; and
3. an outer coating having the following formulation (m.p. about 150° F.);
   57 percent $C_{20\text{-}22}$ HAPS
   22 percent isopropyl alcohol
   20 percent antistatic agent
   1 percent of one of the perfume substances of of Table I of Example V, supra.

A fabric softening composition prepared as set forth above having the above aroma characteristics as set in Table I of Example V, supra essentially consists of a substrate having a weight of about 3 grams per 100 square inches, a substrate coating of about 1.85 grams per 100 square inches of substrate and an outer coating of about 1.4 grams per 100 square inches of substrate, thereby providing a total aromatized substrate and outer coating weight ratio of about 1:1 by weight of substrate. The aroma set forth in Table I of Example V is imparted in a pleasant manner to the headspace in the dryer on operation thereof, using said dryer-added fabric softening non-woven fabric.

EXAMPLE XIII

Raspberry Flavor Formulation

The following basic raspberry flavor formulation is produced:

| Ingredient | Parts by Weight |
|---|---|
| Vanillin | 2.0 |
| Maltol | 5.0 |
| Parahydroxybenzylactone | 5.0 |
| Alpha-ionone (10% in propylene glycol) | 2.0 |
| Ethyl butyrate | 6.0 |
| Ethyl acetate | 16.0 |
| Dimethyl sulfide | 1.0 |
| Isobutyl acetate | 13.0 |
| Acetic acid | 10.0 |
| Acetaldehyde | 10.0 |
| Propylene glycol | 930.0 |
| | 1000.0 |

This formulation is divided into four portions. To the first portion the compound having the structure:

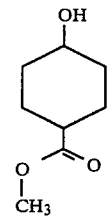

is added (produced according to Example I).

To the second portion, the compound having the structure:

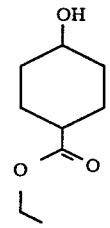

(prepared according to Example II) is added.

To the third portion, the compound having the structure:

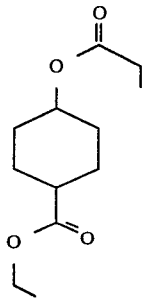

is added (produced according to Example III).

To the fourth portion, nothing is added.

The flavor containing the compound having the structure:

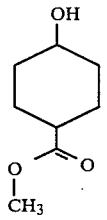

has a raspberry aroma and taste with blueberry, cherry and sweet fruity aroma and taste nuances with the compound having the structure:

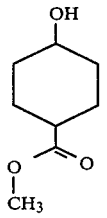

being added in the amount of 5 ppm.

The flavor containing the compound having the structure:

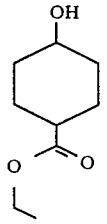

has a fresh raspberry aroma and taste profile with the compound having the structure:

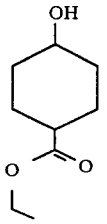

being added at the rate of 2 ppm.

The flavor containing the compound having the structure:

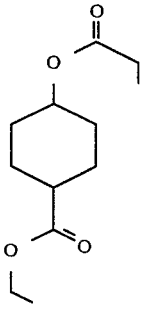

has a fresh "recently picked" raspberry aroma with raspberry kernel nuances with the compound having the structure:

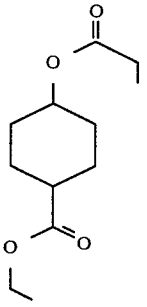

being added at the rate of 0.5 ppm.

The flavors containing the para-acyloxycyclohexyl alkylcarboxylate of our invention have substantially more pleasant and better raspberry aroma and taste profiles. It is the unanimous opinion of a bench panel of five members (not associated with the inventorship entity of the instant application and not associated with the assignee of the instant application) that the para-acyloxycyclohexyl alkylcarboxylate of our invention round the flavor out and contribute to a very natural fresh aroma and taste as found in full ripe raspberries which are recently picked. Accordingly, the flavor with the addition of the para-acyloxycyclohexyl alkylcarboxylates of our invention are unanimously considered a substantially better than the flavors without containing the para-acyloxycyclohexyl alkylcarboxylate of our invention.

EXAMPLE XIV

A. Raspberry Flavor Formulation

20 Grams of the flavor formulation of Example XIII containing one of the para-acyloxycyclohexyl alkylcarboxylates of our invention is emulsified in a solution containing 300 grams gum acacia and 700 grams water. The emulsion is spray-dried with a Bowen Lab Model Drier utilizing 260 c.f.m. of air with an inlet temperature of 500° F. an outlet temperature of 200° F. and a wheel speed of 50,000 rpm.

B. Sustained Release Flavor

The following mixture is prepared:

| Ingredients | Parts by Weight |
|---|---|
| Liquid rasberry flavors of Example XIII containing one of para-acyloxycyclohexyl alkylcarboxylates of our invention | 20.00 |
| Proplylene Glycol | 9.00 |
| Cab-O-Sil ® M-5 Brand of Silica produced by the Cabot corporation of 125 High Street, Boston, Mass. 02110; | 5.00 |
| Physical Properties: | |
| Surface Area: 200 $m^2$/gm | |
| Nominal particle size: 0.012 microns | |
| Density: 2.3 lbs./cu.ft. | |

The Cab-O-Sil ® is dispersed in each of the liquid raspberry flavor compositions of Example XIII with vigorous stirring, thereby resulting in a viscous liquid. 71 Parts by weight of the powder flavor composition of Part A, supra, is then blended into the said viscous liquid, with stirring, at 25° C. for a period of 30 minutes, resulting in a dry, free-flowing sustained release powder.

EXAMPLE XV

10 Parts by weight of 50 Bloom pigskin gelatin is added to 90 parts by weight of water at a temperature of 150° F. The mixture is agitated until the gelatin is completely dissolved and the solution is cooled to 120° F. 20 Parts by weight of each of the liquid raspberry flavor compositions of Example XIII (containing one of the para-acyloxycyclohexyl alkylcarboxylates of our invention) is added individually to solutions which are then homogenized to form an emulsion having a particle size typically in the range of 5–40 microns. The material is kept at 120° F. under which conditions the gelatin will not jell.

Coacervation is induced by adding slowly and uniformly, 40 parts by weight of a 20% aqueous solution of sodium sulphate. During coacervation the gelatin molecules are deposited uniformly about each oil droplet as a nucleus.

Gelation is effected by pouring the heated coacervate mixture into 1,000 parts by weight of 7% aqueous solution of sodium sulphate at 65° F. The resulting jelled coacervate may be filtered and washed with water at temperatures below the melting point of gelatin, to remove the salt.

Hardening of the filtered cake, in this example is effected by washing with 200 parts by weight of 37% solution of formaldehyde in water. The cake is then washed to remove residual formaldehyde.

EXAMPLE XVI

Chewing Gum

100 Parts by weight of chicle are mixed with 4 parts by weight of each of the flavors prepared in accordance with Example XV. 300 Parts of sucrose and 100 parts of corn syrup are added. Mixing is effected in a ribbon blender with jacketed walls of the type manufactured by the Baker Perkins Co.

The resultant chewing gum blends are then manufactured into strips 1 inch in width and 0.1 inches in thickness. The strips are cut into lengths of 3 inches each. On chewing, the chewing gum has a pleasant, long-lasting raspberry flavor.

EXAMPLE XVII

Chewing Gum

100 Parts by weight of chicle are mixed with 18 parts by weight of the flavors prepared in accordance with Example XIV. 300 Parts of sucrose and 100 parts of corn syrup are then added. Mixing is effected in a ribbon blender with jacketed walls of the type manufactured by the Baker Perkins Co.

The resultant chewing gum blends are then manufactured into strips 1 inch in width and 0.1 inches in thickness. The strips are cut into lengths of 3 inches each. On chewing, the chewing gum has a pleasant, long-lasting raspberry flavor.

EXAMPLE XIX

Toothpaste Formulation

The following separate groups of ingredients are prepared:

| Parts by Weight | Ingredients |
|---|---|
| Group "A" | |
| 30.200 | Glycerine |
| 15.325 | Distilled Water |
| .100 | Sodium Benzoate |
| .125 | Saccharin Sodium |
| .400 | Stannous Fluoride |
| Group "B" | |
| 12.500 | Calcium Carbonate |
| 37.200 | Dicalcium Phosphate (Dihydrate) |
| Group "C" | |
| 2.000 | Sodium N—Lauroyl Sarcosinate (foaming agent) |
| Group "D" | |
| 1.200 | Flavor Material of Example XIV(B) |
| 100.00 - Total | |

PROCEDURE:

1. The ingredients in Group "A" are stirred and heated in a steam jacketed kettle to 160° F.
2. Stirring is continued for an additional three to five minutes to form a homogeneous gel.
3. The powders of Group "B" are added to the gel, while mixing, until a homogeneous paste is formed.
4. With stirring, the flavor of "D" is added and lastly the sodium -n-lauroyl sarcosinate.
5. The resultant slurry is then blended for one hour. The completed paste is then transferred to a three roller mill and then homogenized, and finally tubed.

The resulting toothpaste, when used in a normal toothbrushing procedure yields a pleasant raspberry flavor, of constant strong intensity throughout said procedure (1–1.5 minutes).

EXAMPLE XX

Chewable Vitamin Tablets

The flavor material produced according to the procedure of Example XIV(B) is added to a chewable vitamin tablet formulation at a rate of 10 gm/kg, which chewable vitamin tablet formulation is prepared as follows:

In a Hobart Mixer, the following materials are blended to homogeneity:

| Ingredients | Gms/1000 Tablets |
|---|---|
| Vitamin C (ascorbid acid) as ascorbic acid-sodium ascorbate mixture 1:1 | 7.0 |
| Vitamin $B_1$ (thiamine mononitrate) as Rocoat ® thiamine mononitrate 33⅓% (Hoffman La Roche) | 4.0 |
| Vitamin $B_2$ (riboflavin) as | 5.0 |
| Rocoat ® riboflavin 33⅓% | 5.0 |
| Vitamin $B_6$ (pyrdoxine hydrochloride) as Rocoat ® pyridoxine hydrochloride 33⅓% | 4.0 |
| Niacinamide as Rocoat ® niacinamide 33⅓% | 33.00 |
| Calcium pantothenate | 11.5 |
| Vitamin $B_{12}$ (cyanocobalamin) as Merck 0.1% in gelatin | 3.5 |
| Vitamin E (dl-alpha tocopheryl acetate) as dry Vitamin E acetate 33⅓% | 6.6 |
| d-Biotin | 0.044 |
| Flavor of Example XIV(B) | (as indicated above) |
| Certified lake color | 5.0 |
| Sweetener - sodium saccharin | 1.0 |
| Mangesium stearate lubricant | 10.0 |
| Mannitol q.s. to make | 500.0 |

Preliminary tablets are prepared by slugging with flat-faced punches and grinding the slugs to 14 mesh. 13.5 Grams dry Vitamin A Acetate and 0.6 grams Vitamin D are then added as beadlets. The entire blend is then compressed using concave punches at 0.5 grams each.

EXAMPLE XXI

Chewing Tobacco

Onto 100 pounds of tobacco for chewing (85% Wisconsin leaf and 15% Pennsylvania leaf) the following casing is sprayed at the rate of 30%:

| Ingredients | Parts by Weight |
|---|---|
| Corn syrup | 60.0 |
| Licorice | 10.0 |
| Glycerine | 20.0 |
| Fig Juice | 4.6 |
| Raspberry flavor formulation of Example XIV(B) | 5.0 |

The resultant product is redried to a moisture content of 20%. On chewing, this tobacco has an excellent substantially consistent, long-lasting raspberry-like nuance, in conjunction with the tobacco notes.

What is claimed is:

1. A process for augmenting or enhancing the aroma of a consumable material selected from the group consisting of perfume compositions, colognes, and perfumed articles, comprising the step of adding to said consumable material an aroma augmenting or enhancing quantity of at least one para-acyloxycyclohexyl alkylcarboxylate defined according to the structure:

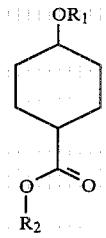

wherein $R_1$ represents hydrogen or $C_2$–$C_4$ acyl and $R_2$ represents $C_1$–$C_3$ alkyl.

2. The process of claim 1 wherein the para-acyloxycyclohexyl alkylcarboxylate has the structure:

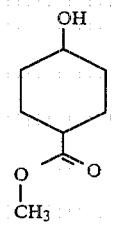

3. The process of claim 1 wherein the para-acyloxycyclohexyl alkylcarboxylate has the structure:

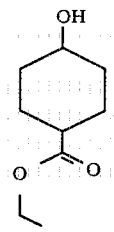

4. The process of claim 1 wherein the para-acyloxycyclohexyl alkylcarboxylate has the structure:

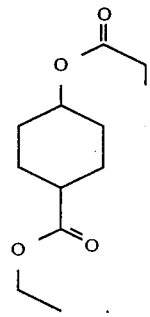

5. The process of claim 1 wherein the consumable material is a perfume composition or cologne.

6. The process of claim 1 wherein the consumable material is a perfumed article and the perfumed article is a solid or liquid anionic, cationic, nonionic or zwitterionic detergent.

7. The process of claim 1 wherein the consumable material is a perfumed article and the perfumed article is a perfumed polymer.

8. The process of claim 1 wherein the consumable material is a perfumed article and the perfumed article is a fabric softener composition or fabric softener article.

* * * * *